US009624661B2

(12) United States Patent
Poulakis

(10) Patent No.: US 9,624,661 B2
(45) Date of Patent: Apr. 18, 2017

(54) COVERING SYSTEM FOR INSULATION DEVICES ON (LOAD-BEARING) STRUCTURES

(71) Applicant: Gottlieb Binder GmbH & Co. KG, Holzgerlingen (DE)

(72) Inventor: Konstantinos Poulakis, Hildrizhausen (DE)

(73) Assignee: GOTTLIEB BINDER GMBH & CO. KG, Holzgerlingen (DE)

( * ) Notice: Subject to any disclaimer, the term of this patent is extended or adjusted under 35 U.S.C. 154(b) by 0 days.

(21) Appl. No.: 14/421,050

(22) PCT Filed: Aug. 14, 2013

(86) PCT No.: PCT/EP2013/002443
§ 371 (c)(1),
(2) Date: Feb. 11, 2015

(87) PCT Pub. No.: WO2014/037078
PCT Pub. Date: Mar. 13, 2014

(65) Prior Publication Data

US 2015/0204063 A1 Jul. 23, 2015

(30) Foreign Application Priority Data

Sep. 4, 2012 (DE) ..... 10 2012 017 529

(51) Int. Cl.
*E04B 1/76* (2006.01)
*A44B 18/00* (2006.01)
(Continued)

(52) U.S. Cl.
CPC ..... *E04B 1/76* (2013.01); *A44B 18/0003* (2013.01); *A44B 18/008* (2013.01);
(Continued)

(58) Field of Classification Search
CPC ..... E04B 1/76; E04B 1/7629; E04C 2/243; E04C 2/205; E04C 2/284; A44B 18/0003;
(Continued)

(56) References Cited

U.S. PATENT DOCUMENTS 3,251,399 A * 5/1966 Grossman ..... E06B 3/285 160/180
3,469,289 A * 9/1969 Whitacre ..... A44B 18/0003 24/442

(Continued)

FOREIGN PATENT DOCUMENTS

DE 197 52 819 A1 6/1999
DE 10 2004 015 321 A1 10/2005

(Continued)

*Primary Examiner* — Babajide Demuren
(74) *Attorney, Agent, or Firm* — Wenderoth, Lind & Ponack, L.L.P.

(57) ABSTRACT

A covering system for insulation devices (2) on (load-bearing) structures has a connecting device (24) including a carrier surface (28) with touch-and-close fastener elements (30) that can be connected to correspondingly designed touch-and-close fastener elements (22). A reactive functional surface (36) is fitted, as a further component of the connecting device (24), on the side (34) of the carrier surface (28) directed away from the touch-and-close fastener elements (30). The reactive functional surface bonds permanently, under predeterminable shaping pressure and at a predeterminable reaction temperature, to a preferably closed-cell foam material (4; 26) of the insulation device (2).

21 Claims, 5 Drawing Sheets

(51) Int. Cl.

| | |
|---|---|
| ***E04F 13/08*** | (2006.01) |
| ***E04F 13/04*** | (2006.01) |
| ***E04C 2/20*** | (2006.01) |
| ***E04C 2/24*** | (2006.01) |
| ***E04C 2/284*** | (2006.01) |
| ***E04F 15/02*** | (2006.01) |

(52) U.S. Cl.
CPC ..... *A44B 18/0073* (2013.01); *E04B 1/7629* (2013.01); *E04C 2/205* (2013.01); *E04C 2/243* (2013.01); *E04C 2/284* (2013.01); *E04F 13/04* (2013.01); *E04F 13/047* (2013.01); *E04F 13/0882* (2013.01); *E04F 15/02138* (2013.01); *Y10T 24/2733* (2015.01)

(58) Field of Classification Search
CPC ... A44B 18/008; A44B 18/0073; E04F 13/04; E04F 13/047; E04F 13/0882; Y10T 24/2733
USPC ..... 52/506, 60, 605, DIG. 13
See application file for complete search history.

(56) References Cited

U.S. PATENT DOCUMENTS

| | | | | | |
|---|---|---|---|---|---|
| 3,668,808 | A * | 6/1972 | Perina | E06B 1/60 | 428/100 |
| 4,068,428 | A * | 1/1978 | Peterson, III | E06B 3/28 | 160/354 |
| 4,271,566 | A * | 6/1981 | Perina | A44B 18/00 | 160/180 |
| 4,726,975 | A * | 2/1988 | Hatch | A44B 18/0076 | 24/444 |
| 4,744,189 | A * | 5/1988 | Wilson | B44C 1/28 | 40/908 |
| 4,761,318 | A * | 8/1988 | Ott | A44B 18/0011 | 156/244.11 |
| 4,931,344 | A * | 6/1990 | Ogawa | A44B 18/0073 | 24/444 |
| 4,996,812 | A * | 3/1991 | Venable | E04D 5/12 | 428/148 |
| 5,110,649 | A | 5/1992 | Morse et al. | | |
| 5,482,755 | A | 1/1996 | Manning | | |
| 5,537,793 | A * | 7/1996 | Murasaki | A44B 18/00 | 24/306 |
| 5,890,327 | A * | 4/1999 | Merser | E04B 7/02 | 156/71 |
| 6,298,624 | B1 * | 10/2001 | Pacione | A47G 27/025 | 52/311.2 |
| 6,306,477 | B1 * | 10/2001 | Pacione | A47G 27/0293 | 428/100 |
| 6,745,531 | B1 * | 6/2004 | Egan | E04B 1/70 | 52/302.1 |
| 8,425,998 | B2 * | 4/2013 | Poulakis | A44B 18/0073 | 24/304 |
| 2003/0070391 | A1 * | 4/2003 | Tachauer | A44B 18/0049 | 52/745.21 |
| 2003/0134083 | A1 * | 7/2003 | Wang | A44B 18/0003 | 428/99 |
| 2007/0264482 | A1 * | 11/2007 | Banker | A44B 18/0049 | 428/223 |
| 2009/0255201 | A1 * | 10/2009 | Kraus, Jr. | B29C 39/18 | 52/309.5 |
| 2013/0111840 | A1 * | 5/2013 | Bordener | E04B 1/68 | 52/393 |

FOREIGN PATENT DOCUMENTS

| | | | | |
|---|---|---|---|---|
| DE | 10 2009 013 712 | A1 | 9/2010 | |
| DE | 10 2010 047 242 | A1 | 4/2012 | |
| DE | EP 2436851 | A2 * | 4/2012 | E04B 1/7633 |
| EP | 0 990 746 | A1 | 4/2000 | |
| EP | 1 795 654 | A2 | 6/2007 | |
| EP | 2 365 156 | A1 | 9/2011 | |
| EP | 2 602 109 | A2 | 6/2013 | |
| GB | 2 188 080 | A | 9/1987 | |
| WO | WO 2009/126768 | A2 | 10/2009 | |

* cited by examiner

COVERING SYSTEM FOR INSULATION DEVICES ON (LOAD-BEARING) STRUCTURES

FIELD OF THE INVENTION

The invention relates to a covering system for insulation devices on structure work and support structures. The system includes a connecting device of a support surface having touch-and-close fastening elements, which can be connected to correspondingly designed touch-and-close fastening elements. In addition, the invention also relates to a connecting device for such a covering system.

BACKGROUND OF THE INVENTION

A covering system of this kind is already known from DE 10 2010 047 242 A1. In the known system, heat insulation panels may be affixed to a construction-side subsurface, such as masonry, by anchoring elements in the manner of plug screws. Retaining plates that protrude slightly from the outside of the heat insulation panels are located at the ends of the anchoring elements facing away from the construction-side subsurface. The retaining plates form mounting locations for components, for example in the form of plate-shaped facade elements. These structural elements are anchored by a touch-and-close fastening, formed out of touch-and-close fastening elements. These elements are fixed on the side of the heat insulation panels to the plate-shaped mounting locations and are fixed by touch-and-close fastening elements of a connecting device that correspond thereto. The elements are located on the side of the plate-shaped component that is facing the heat insulation panels. This connecting device has a support surface, which, having one side in contact with a large area of the respective plate-shaped component, is permanently connected thereto, and which, at the other side of said support surface, forms the touch-and-close fastening elements, which can be engaged in an adhesive-like engagement with the corresponding touch-and-close fastening elements at the plate-like mounting locations. This type of anchoring by forming a touch-and-close fastening permits quick and easy affixing of the plate-shaped structural elements. An advantageous option is subsequently adjusting or, if necessary, exchanging structural elements by releasing the touch-and-close fastening. The known solution is not satisfactory in so far as the dependability of the fixture is dependent on the condition of the plate-shaped structural elements. As a result, the reliable attachment of the support surface having the touch-and-close fastening elements is thus strongly dependent on the surface condition of the respective component that is to be affixed. One is then limited to the use of materials that are suitable for the facade element that is to be affixed. In particular, difficulties arise in the case of structural elements made out of closed-celled foam materials.

SUMMARY OF THE INVENTION

An object of the invention is to provide an improved covering system that, while retaining the advantages of the above mentioned prior art, makes a reliable fastening of components that are made out of closed-celled foam materials.

This object is basically achieved according to the invention by a covering system having a reactive functional surface affixed on the side of the support surface facing away from the touch-and-close fastening elements as an additional component of the connecting device. The reactive functional surface bonds permanently to a preferably closed-celled foam material of the respective insulation device at a predeterminable shaping pressure and at a predeterminable reaction temperature. As a result, unlike a conventional adhesive bond between the support surface and the associated component by a reactive functional surface located on the support surface, a melting process occurs under pressure that is carried out at a reaction temperature. The melting process allows a reliable bonding of the support surface with components, even when the components have a surface condition that is unfavorable for conventional adhesive connections. In particular, the advantageous option of reliably affixing the carrier to components having an unfavorable surface condition is thereby made available, for example on preferably closed-celled foam materials, for example made out of foam or cellular glass or out of a Styrofoam material.

In an advantageous manner, the reaction surface is laminated as a film on the support surface or otherwise connected thereto in a form-locking or material-locking manner.

In especially advantageous embodiments, the reactive functional surface may additionally be connected to a grid or net structure, which completely covers the support surface, and which is preferably reactively connected thereto. The connecting device thus formed is distinguished by particularly favorable structural properties.

In embodiments of this kind, the support surface may be permanently, directly connected by the reactive functional surface thereof, or permanently connected by the grid or net structure thereof to the preferably closed-celled foam material of the respective insulation device.

For a connection with a foam or cellular glass as a preferably closed-celled foam material, the reactive functional surface may advantageously be formed out of a thermo-adhesive film made of polyurethane resin. During the molding process, polyurethane preferably also enters into a chemical bond with the binding agent, which is usually mixed with the cellular glass. The reactive functional surface may also be designed for a bond with a Styrofoam material, such as a preferably closed-celled foam material made out of a modified polyethylene.

In terms of the support surface, the support surface preferably may be formed out of a velour having closed pile threads, or out of a knit fabric, preferably out of a polyamide 6 plastic material.

In terms of the design of the touch-and-close fastening, advantageously one of the touch-and-close fastening elements is a hook closure material, which can be permanently connected to wall parts of the structure work or support structure, or to the side of the respective insulation device, which side is facing the touch-and-close fastening elements of the support surface of the connecting device.

In the production of the connection with the aid of the reactive functional surface, advantageously, in the case of a reaction temperature of 120° C. to 150° C., preferably between 130° C. and 150° C., especially preferably between 135° C. and 140° C., the reactive functional surface designed as a polyurethane film enters into the connection with the foam or cellular glass in the case of a predeterminable shaping pressure, because in this region, the binding agent, which is mixed with the foam or, respectively, cellular glass, is fully cured at the desired speed. In so doing, the binding agent not only connects the individual granules of foam and cellular glass with one another, but it desirably also enters into a chemical bond with the polyurethane film. The temperature behavior of the film is also selected such that a specific viscosity range is achieved at the point in time at which shape forming occurs so that it enters into a form-locking connection to the foam and cellular glass. During demolding/cooling, the selected thermoplastic material exhibits sufficient cohesion to demold the bond that has been formed in a form-locking manner.

In one type of insulation device, in which the connecting device is allocated to a plate-shaped structural element made out of foam or cellular glass, the covering system may have the following structure:

velour,
reactive functional surface,
grid or net structure,
foam or cellular glass and
grid structure.

In an insulation device, in which the connecting device is disposed on an insulating material that is to be applied to a construction-side subsurface, the covering system may have the following structure:

velour,
reactive functional surface,
closed-celled foam material, preferably in the form of Styrofoam or polyurethane foam and
optionally as a finish, a foam or cellular glass covering for the closed-celled foam material.

The subject matter of the invention is also a connecting device for a covering system according to the invention.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1:
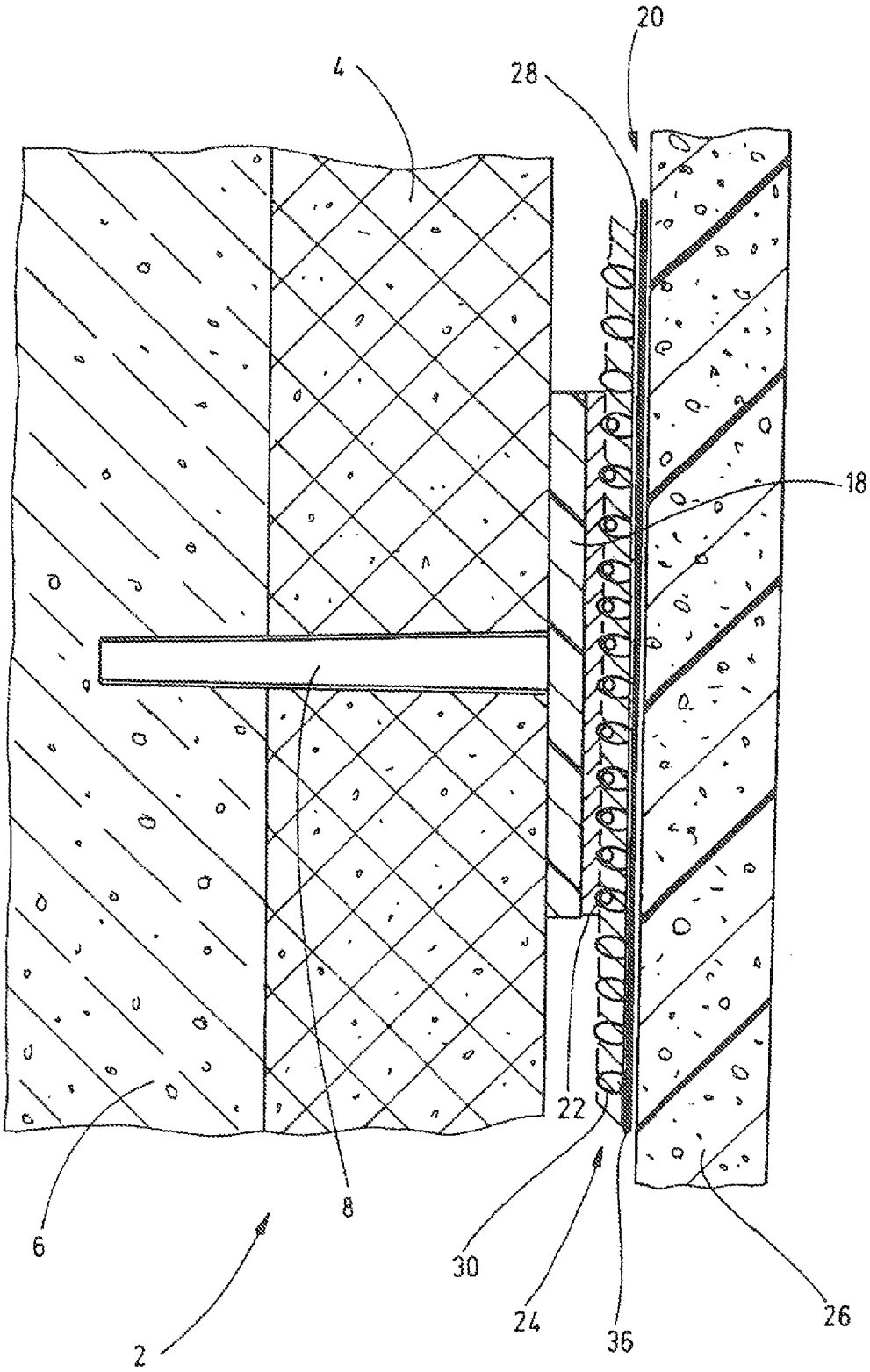
FIG. 1 is a partial side view in section of an insulation device for buildings equipped with a covering system according to a first exemplary embodiment of the invention, wherein components of the associated connecting device and of a touch-and-close fastening formed therewith are highly schematically simplified and not depicted to scale.
Figure 2:
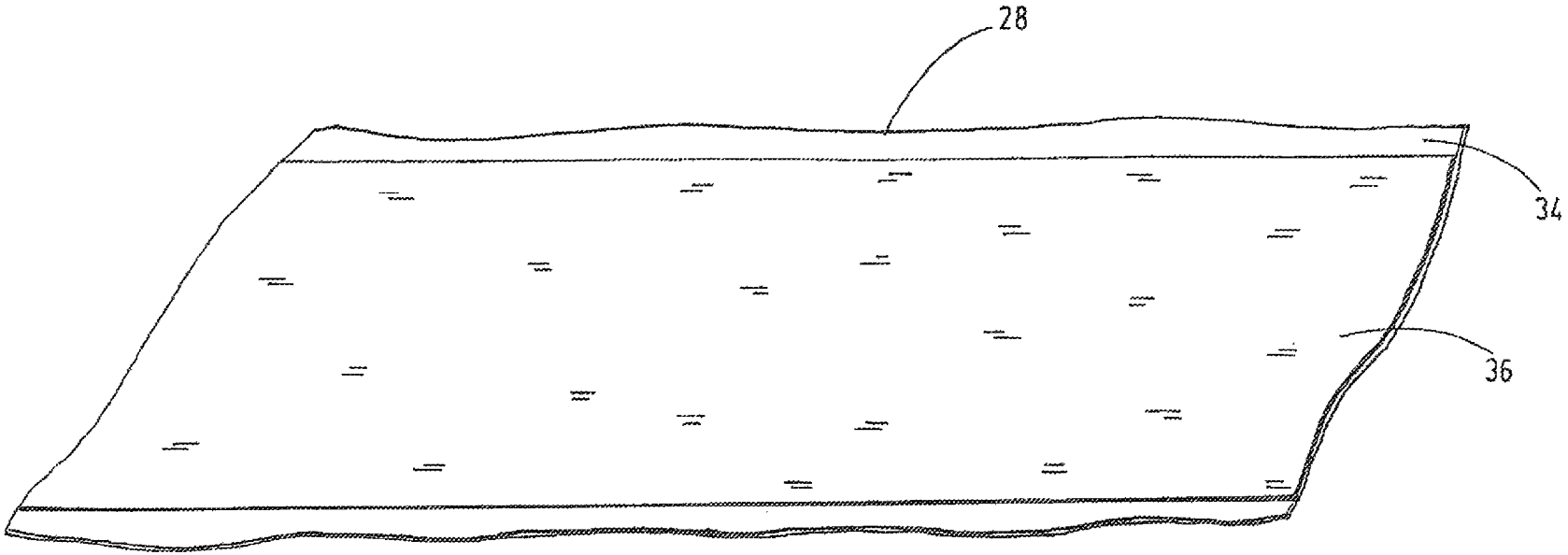
FIG. 2 is an perspective view of the connecting device of FIG. 1 seen from the side of the support surface that is facing away from the touch-and-close fastening elements.

FIG. 1 shows a first embodiment of the covering system according to the invention in conjunction with an insulation device 2 having a succession of insulating panels 4 affixed to a construction-side subsurface such as masonry 6. The insulating panels 4, of which succession only one is visible in FIG. 1, are made out of mineral wool or out of a closed-celled foam material such as Styrofoam or polyurethane. In the case of the example shown in FIG. 1, the insulating panels 4 are attached by plug screws 8 having a flat head 18. The outside of each of the flat heads 18 forms a mounting location for the covering system 20 allocated to the insulation device 2. For this purpose, a touch-and-close fastening element 22 is fixed to the outer surface of each of the flat heads 18, for example by adhesion or welding in the case of touch-and-close fastening elements made of plastic.

In the example shown in FIG. 1, the covering system 20 has plate-shaped structural elements 26 as covering parts, which serve as facade elements and of which only one structural element 26 is visible in FIG. 1. These structural elements 26 are a closed-celled foam material, preferably in the form of a so-called foam or cellular glass. The use of foam or cellular glass is ecologically advantageous because this building material can be manufactured out of recycled waste glass. The collected waste glass can be completely recycled in a closed recycling in closed-loop recycling. This building material is very well suited as a facade element because foam or cellular glass is light-weight, heat insulating, sound insulating, pressure-resistant, non-flammable, acid resistant, pest-proof and easy to handle. In principle, recycling is also possible in that the foam or cellular glass can be melted down again.

As a foam material, such building materials do not offer particularly favorable conditions for the formation of a permanent connection to the associated structure work or support structure. The covering system according to the invention solves this problem by the special design of the connecting device 24. Details of the structure of the connecting device 24 are clearly apparent in the further FIGS. 2 to 5. The main component of the connecting device 24 is a support surface 28, which forms a touch-and-close fastening element 30 on one side. This fastening element corresponds to the touch-and-close fastening element 22, which is located at the respective mounting location of the insulation device 2, or more precisely, on the plate-shaped cover parts 18 on the insulating panels 4. In the present example, the touch-and-close fastening element 30 on the respective support surface 28 has interlocking elements in the form of mesh or loops that interact with hook or mushroom-shaped interlocking elements of the appropriate touch-and-close fastening elements 22 of the insulation device 2. In the present example, the support surface 28 is formed of a velour having closed pile threads or of a knit fabric, for example out of a polyamide 6 plastic material. The known method described in DE 10 2008 007 913 A1 may be used to form the interlocking elements 32 on the velour of the support surface 28 and the interlocking elements for the touch-and-close fastening elements 22 of the insulation device 2. In the case of the present example, the interlocking elements 32 of the touch-and-close fastening element 30 of the support surface 28 of the connecting device 24 are formed as mesh or loops, while in the case of the touch-and-close fastening elements 22, the interlocking elements are formed having a mushroom-shape.

A functional surface 36 is affixed on the side 34 of the support surface 28 facing away from the touch-and-close fastening elements 30 as an additional component of the connecting device 24. This functional surface is laminated as a film on the support surface 28 or otherwise connected thereto in a form-locking or material-locking manner. To establish a permanent connection to a closed-celled foam material in the form of a foam or cellular glass, the reactive functional surface 36 is made out of a thermo-adhesive film of polyurethane resin. When a Styrofoam material is used as a closed-celled foam material, the functional surface 36 is formed of a polyethylene. Through the application of pressure and heat, this thermo-adhesive layer permits a permanent connection to the closed-celled foam material of the appropriate structural element 26, for example made of foam or cellular glass. In the case where a polyurethane film is used as a functional surface 36, the connection may be formed by melting at reaction temperatures in the range of 120° C. to 150° C., with a shaping pressure in the range of approximately 150 bar. In the case of a polyurethane resin, a reaction temperature between 135° C. and 140° C. may preferably be used.

Figure 3:
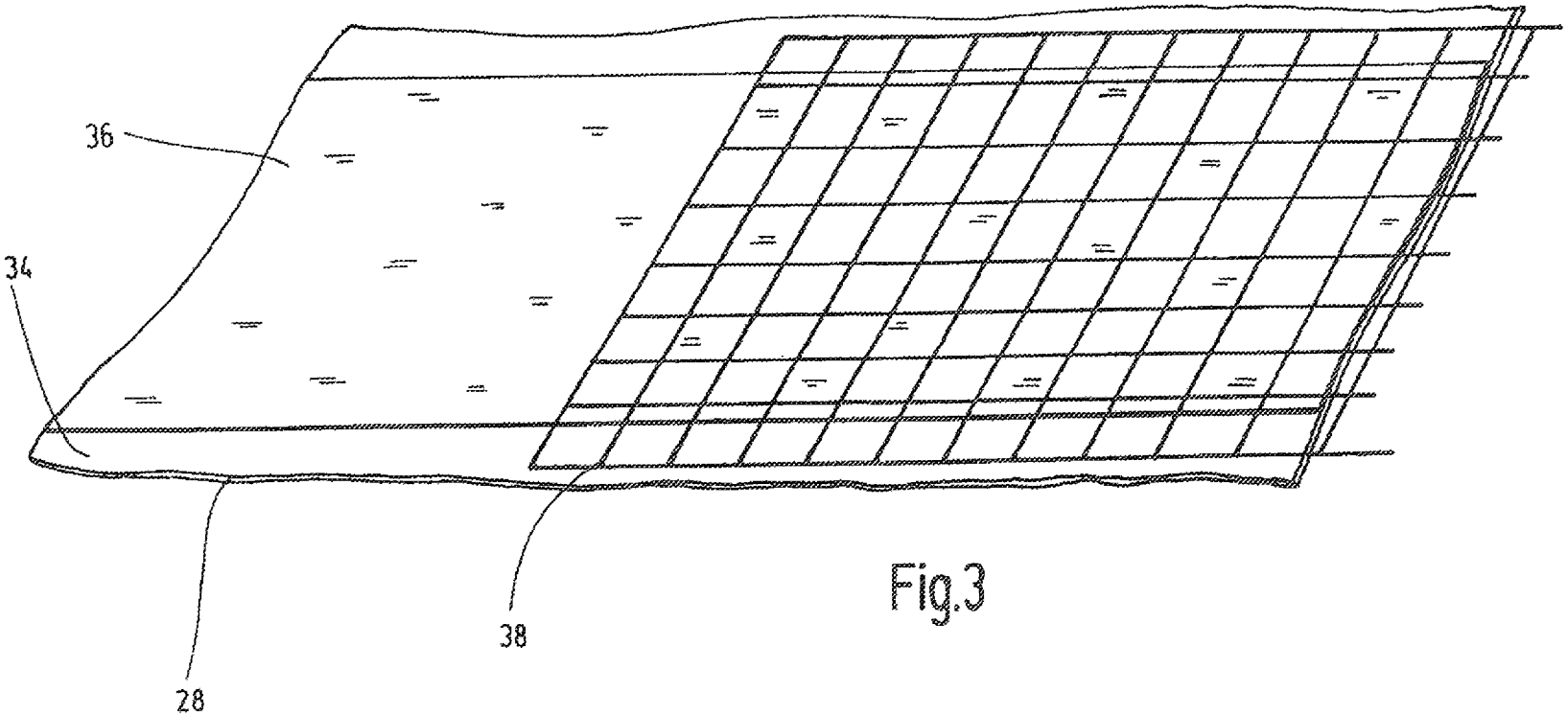
FIG. 3 is a perspective view of a connecting device according to a second exemplary embodiment of the invention seen from the side of the support surface that is facing away from the touch-and-close fastening elements.
Figure 4:
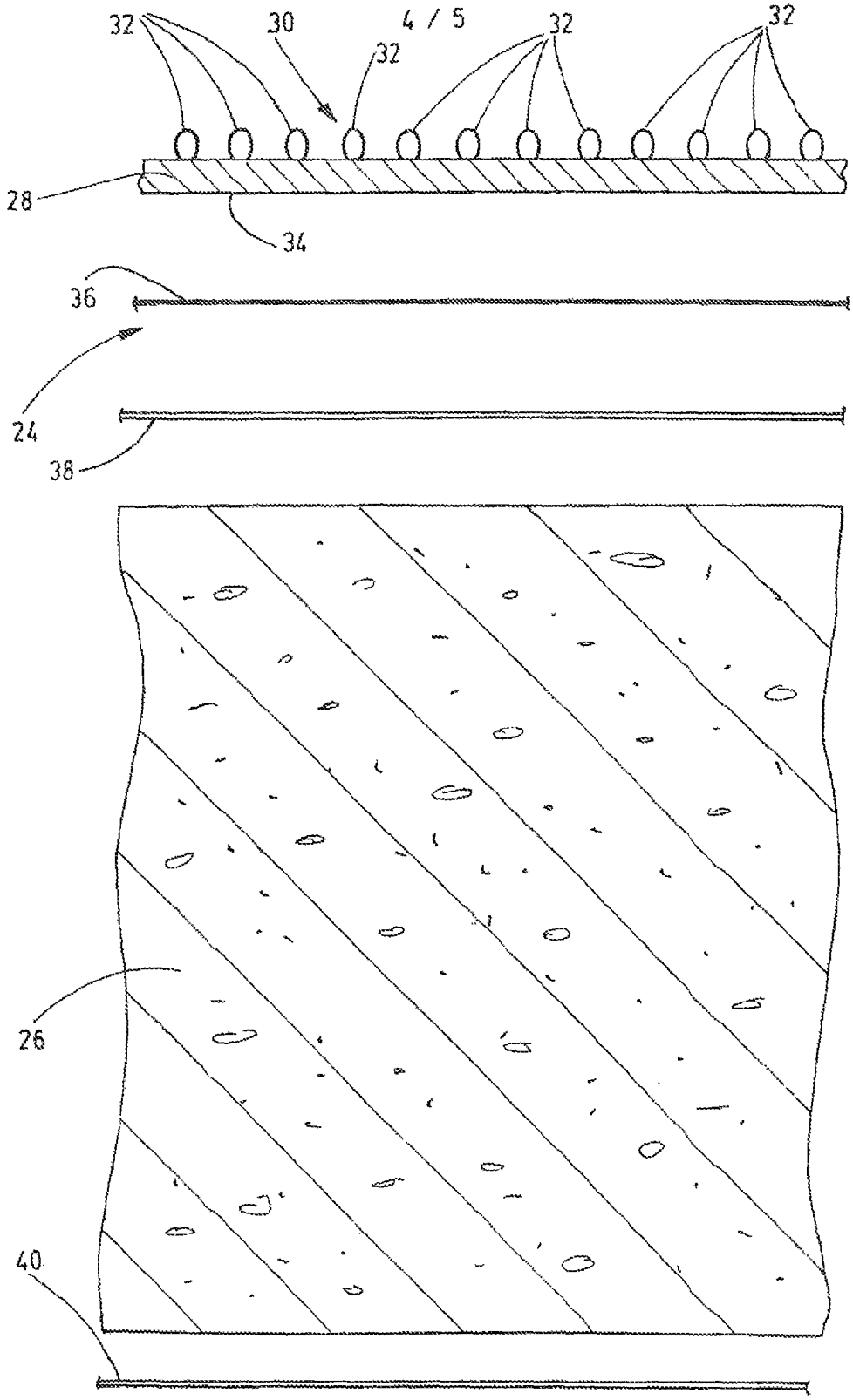
FIG. 4 is a highly schematically simplified, enlarged and exploded side view in section of the structure of an embodiment of the covering system with the connecting device of FIG. 3.

FIGS. 3 and 4 show that the functional surface 36 is additionally covered by a grid or net structure 38, which is reactively connected to the functional surface 36. The grid structure 38 may be formed out of a glass fiber fabric.

As FIG. 4 also shows, optionally, a grid structure 40 may likewise be affixed to the side of the structural element 26 that is facing away from the connecting device 24, as is also the case with the grid structure 38. This arrangement may serve as a basic element for an exterior plaster for a facade, for example.

Figure 5:
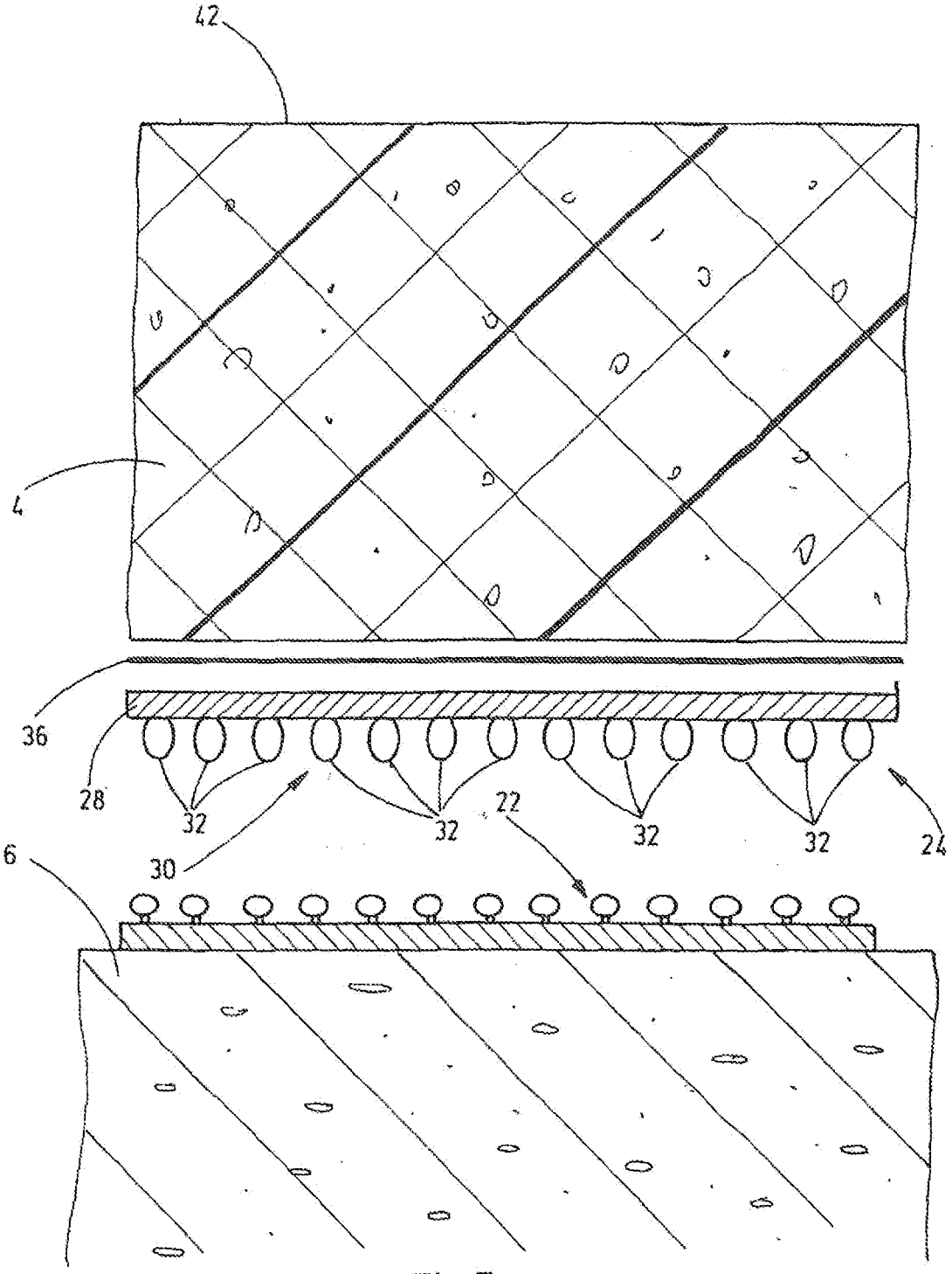
FIG. 5 is a highly schematically simplified, enlarged and exploded side view in section of the structure of the covering system according to the invention in use in another kind of insulation device.

While FIG. 4 illustrates the structure of the connecting system 24 for an insulation device 2, such as that which is shown in FIG. 1, where the insulating panels 4 are in contact with the construction-side masonry 6, FIG. 5 elucidates a structure in which the connecting device 24 creates the permanent connection between the masonry 6 and heat insulation panels 4. In this case, the reactive functional surface 36 permits the permanent connection of the support surface 28 to the closed-celled foam material of the insulating panels 4, for example made out of Styrofoam or polyurethane. On the other hand, a structural element or facade element such as the structural element 26 formed of foam or cellular glass may optionally be affixed to the outside 42 of the heat insulation panels 4, which is not shown in FIG. 5. A connecting device 24 would be provided with a support surface 28 and functional surface 36 for the connection to the outside 42. Again, an additional grid and net structure 38 may be provided on the functional surface 36 of the respective connecting device 24 as part of the connecting device 24 in the system from FIG. 5.

While various embodiments have been chosen to illustrate the invention, it will be understood by those skilled in the art that various changes and modifications can be made therein without departing from the scope of the invention as defined in the claims.

The invention claimed is:

1. A covering system for mounting insulation devices on support work and support structures, comprising:

a connecting device having a support surface with first touch-and-close fastening elements being on a first side of said support surface and being connected to corresponding designed, second touch-and-close fastening elements on a flat head of a plug screw; and a reactive functional surface affixed on a second side of said support surface, said second side facing away from said first side, said reactive functional surface being an additional component of said connecting device and being permanently bonded to a closed-celled foam material of an insulation device at a predeterminable shaping pressure and at a predeterminable reaction temperature, said reactive functional surface being a closed-celled foam material of a thermo-adhesive film of polyurethane resin connected to a foam glass or a cellular glass.

2. A covering system according to claim 1 wherein said thermo-adhesive film is laminated to said support surface.

3. A covering system according to claim 1 wherein said reactive functional surface is connected to a grid or net structure completely covering said second side of said support surface and reactively connected to said support structure.

4. A covering system according to claim 3 wherein said support structure is permanently and directly connected by said grid or net structure to said closed-celled foam material of said insulation device.

5. A covering system according to claim 1 wherein said support structure is permanently and directly connected by said reactive functional surface to said closed-celled foam material of said insulation device.

6. A covering system according to claim 1 wherein said support structure comprises at least one of velour having at least one of closed pile threads or of a knit fabric of a polyamide 6 plastic material.

7. A covering system according to claim 1 wherein the second touch-and-close fastening elements are hook closures permanently connected by said plug screw to at least one of wall parts of the support work or the support structure or to a side of said insulation device facing said first touch-and-close fastening elements.

8. A covering system according to claim 1 wherein said reaction temperature is 120° C. to 150° C.; and said reactive functional surface is thermoplastically formed and is connected at least one of the foam or cellular glass.

9. A covering system according to claim 8 wherein said reactive temperature is 130° C. to 150° C.

10. A covering system according to claim 9 wherein said reactive temperature is 135° C. to 140° C.

11. A covering system according to claim 1 has a structure of a velour;
said reactive functional surface;
a first grid or net structure;
the foam glass or the cellular glass; and
a second grid structure.

12. A covering system according to claim 1 has a structure of a velour;
said reactive functional surface;
said closed-celled foam material; and
a finish of at least one of the foam glass or the cellular glass covering said closed-celled foam material.

13. A building with a covering system for mounting insulation devices on support work and support structures, comprising:

a connecting device having a support surface with first touch-and-close fastening elements being on a first side of said support surface and being connected to corresponding designed, second touch-and-close fastening elements, said second touch-and-close fastening elements being a velour;

a reactive functional surface affixed on a second side of said second touch-and-close fastening elements, said second side facing away from said first side, said reactive functional surface being an additional component of said connecting device and being permanently bonded to a closed-celled foam material of an insulation device at a predeterminable shaping pressure and at a predeterminable reaction temperature;

a first grid or net structure on said reactive functional surface;

a foam glass or cellular a glass connected to said reactive functional surface; and a second grid structure connected to a side of said foam glass or said cellular glass opposite said first grid or net structure.

14. A building with a covering system for mounting insulation devices on support work and support structures, comprising:

a connecting device having a support surface with first touch-and-close fastening elements being on a first side of said support surface and being connected to corresponding designed, second touch-and-close fastening elements, said second touch-and-close fastening elements being a velour and being on a flat head of a plug screw;

a reactive functional surface affixed on a second side of said second touch-and-close fastening elements, said second side facing away from said first side, said reactive functional surface being an additional component of said connecting device and being permanently bonded to a closed-celled foam material of an insulation device at a predeterminable shaping pressure and at a predeterminable reaction temperature, said closed-celled foam material being at least one of closed-cell extruded polystyrene foam or a polyurethane foam; and a finish of at least one of a foam glass or a cellular glass covering said closed-celled foam material.

15. A connecting device for mounting insulation devices on support work or support structures, comprising:

a support surface with first touch-and-closed fastening elements being on a first side of said support surface and being connectable to correspondingly designed, second touch-and-close fastening elements on a flat head of a plug screw;

a reactive functional surface affixed on a second side of said support surface, said second side facing away from said first side, said reactive functional surface being permanently connectable to a closed-celled foam material of insulation devices at a predeterminable shaping pressure and a predeterminable reaction temperature; and a grid structure being directly connected to said reactive functional surface and completely covering said second side of said support structure.

16. A connecting device according to claim 15 wherein said grid structure is reactively connected to said reactive functional surface.

17. A connecting device according to claim 15 wherein said reactive functional surface is a film laminated to said support surface.

18. A connecting device according to claim 15 wherein said reactive functional surface comprises a closed-celled foam material of a thermo-adhesive film of polyurethane resin connectable to at least one of a foam glass or a cellular glass.

19. A connecting device according to claim 15 wherein said reactive functional surface comprises a closed-celled foam material of polyethylene connectable to a closed-cell extruded polystyrene foam material.

20. A connecting device according to claim 15 wherein said support surface comprises at least one of a velour having closed pile threads or of a knit fabric of polyamide 6 material.

21. A connecting device according to claim 10 wherein said second touch-and-close fastening elements are on a flat head of a plug screw.

* * * * *